United States Patent [19]

King

[11] Patent Number: 4,631,824

[45] Date of Patent: Dec. 30, 1986

[54] METHOD OF MANUFACTURING A MULTI-WIRE CONTACT ASSEMBLY

[75] Inventor: William H. King, Riverside, Calif.

[73] Assignee: Bourns, Inc., Riverside, Calif.

[21] Appl. No.: 754,382

[22] Filed: Jul. 11, 1985

[51] Int. Cl.[4] ..... H01R 43/00

[52] U.S. Cl. ..... 29/884; 339/75 MP; 339/252 R

[58] Field of Search ..... 29/874, 879, 882, 884, 29/863; 339/75 MP, 252 R

[56] References Cited

U.S. PATENT DOCUMENTS 3,628,245 12/1971 Mates et al. ..... 29/863

*Primary Examiner*—Howard N. Goldberg
*Assistant Examiner*—Carl J. Arbes
*Attorney, Agent, or Firm*—Howard J. Klein; William G. Becker

[57] ABSTRACT

A method for manufacturing a contact assembly for an electronic component commences with providing (1) a length of wire formed into a continuous series of loops each having a pair of legs joined at a closed end, the series of loops comprising first and second pluralities of loops extending laterally in opposite directions from a longitudinal axis, each loop in one plurality axially located between the legs of a loop in the other plurality; and (2) a strip of metal having a plurality of prongs extending laterally from one side and spaced apart by the same distance as are the loops in the first plurality. The prongs are bent to form a slightly acute angle with the strip. The length of wire is attached to the strip so that each of the first plurality of loops extends into the space previously occupied by a prong before it was bent, the second plurality of loops extending outwardly from the opposite side of the strip. An upwardly convex radius is formed in the legs of the first plurality of loops near the closed ends thereof, and a downwardly convex radius is similarly formed in the legs of the second plurality of loops. The strip is cut to form a flap underlying each loop in the second plurality. The flap is folded over to superimpose each loop of the second plurality onto one of the loops in the first plurality in an overlapping relationship.

16 Claims, 10 Drawing Figures

10
20a
12a
12a
20a
16a
18b
12a
14
16b
20b
12b
18a
12b
12b
20b
22

24
10
26
28

32

36
30
36
38
38
40
40
34

42
30
44
42

FIG. 5
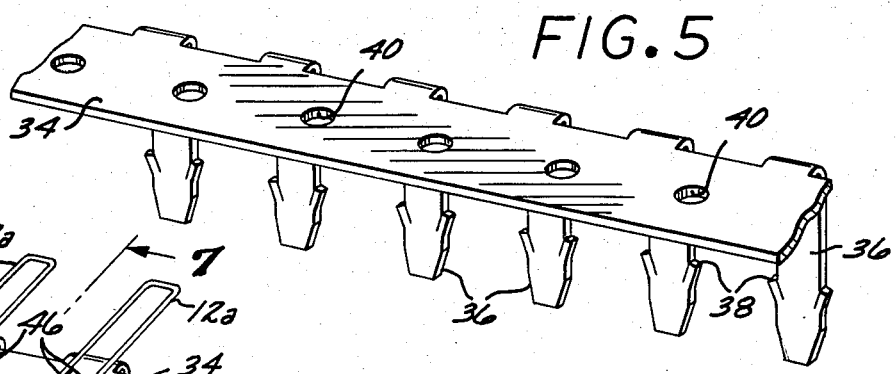
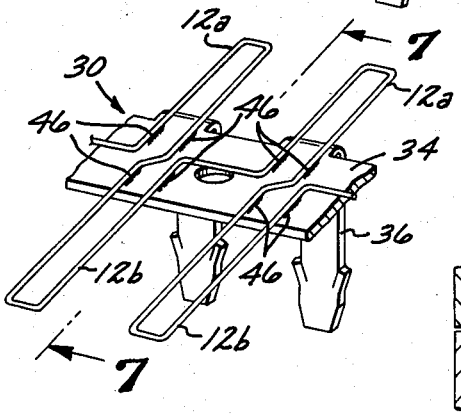
FIG. 6
FIG. 7
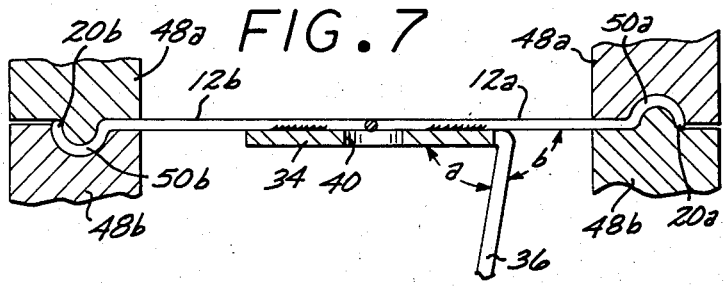
FIG. 8
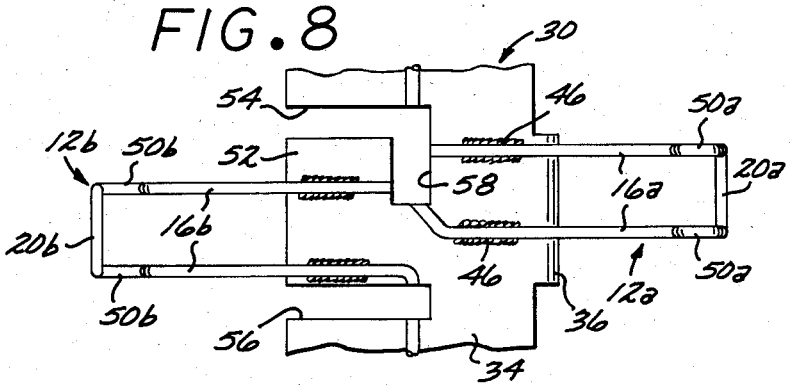
FIG. 10
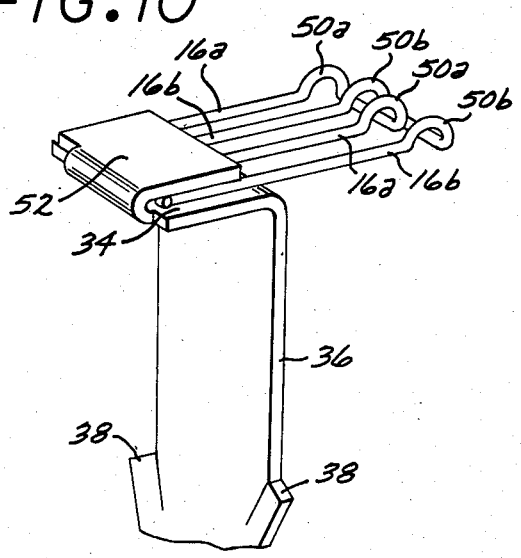
FIG. 9
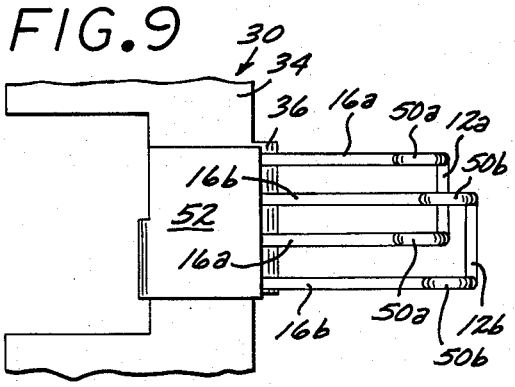

METHOD OF MANUFACTURING A MULTI-WIRE CONTACT ASSEMBLY

CROSS-REFERENCE TO RELATED APPLICATION

This application is related to previously-filed, copending application Ser. No. 690,566, filed Jan. 11, 1985 now U.S. Pat. No. 4,583,806, for "LOW INSERTION-FORCE SOCKET FOR SMALL OUTLINE IC DEVICE".

BACKGROUND OF THE INVENTION

This invention relates generally to the field of electronic devices and components. More specifically, this invention relates to a contact assembly for an electronic component, and to a method of manufacturing such an assembly.

A multitude of electronic components and devices use discrete contact assemblies for providing electrical and mechanical connection between the component and a circuit board. The use of such contact assemblies is common, for example, in sockets that allow components to be removably plugged into circuit boards. In such sockets, the assembly includes a terminal portion that is a conductive pin which is mechanically fastened or soldered to the circuit board. The contact portion is a resilient conductive member, situated on the interior of the socket, which provides a firm (but releasable) mechanical connection with an electrical lead of the component installed in the socket, while also providing a good, low-resistance electrical contact with the lead.

In contact assemblies of the prior art, the contacts are largely in one of two broad categories: solid conductor or multi-wire. The solid conductor type of contact comprises a resilient leaf or ribbon of conductive material which is cantilevered or bent to apply a spring force against the installed lead. The multi-wire contact comprises a strip formed of multiple wires laid side-by-side, and mounted in cantilevered fashion to provide a spring contact function.

The multi-wire form of contact has generally been preferred in low current applications, due largely to its lower contact resistance as compared with the solid conductor contact. This lower contact resistance is a result of the ability of the multi-wire contact to conform somewhat to the shape of the installed lead. Also, multi-wire contacts exhibit good durability, and do not easily acquire a "set" from repeated flexing. A disadvantage of prior art multi-wire contacts is their tendency to suffer a separation or "splaying" of the individual wires, with occasional instances of tangling among the wires.

Accordingly, there has been a long-felt but unsatisfied need in the art for a contact assembly that provides the low contact resistance associated with multi-wire contacts, without the tendency of such contacts to splay or tangle. It would further advance the state of the art to provide such a contact assembly which can also be inexpensively mass-produced.

SUMMARY OF THE INVENTION

The present invention, in one aspect, is a method of manufacturing a contact assembly, which method starts with the steps of (1) providing a length of conductive wire formed into a continuous series of elongate loops each having a pair of legs joined at a closed end, the series of loops comprising first and second pluralities of loops extending laterally in opposite directions from a longitudinal axis, the second plurality being axially displaced from the first plurality such that each loop in one plurality has a leg axially located on a line extending between the legs of a loop in the other plurality; and (2) providing a strip of conductive metal having a plurality of spaced-apart prongs extending laterally from one side, the spacing between the prongs being approximately the same as the spacing between the loops in the first plurality. Next, the prongs are bent to form a right, or slightly acute, angle with the strip, and the length of wire formed into loops is attached (by welding or soldering) to the strip so that each of the first plurality of loops extends substantially horizontally into the space previously occupied by one of the prongs before it had been bent. At this intermediate point in the process, the second plurality of loops extends substantially horizontally outward from the side of the strip opposite the first plurality.

In a preferred embodiment of the invention, an upwardly convex radius is advantageously formed in the legs of the first plurality of loops near their closed ends, while a downwardly convex radius is similarly provided in the legs of the second plurality. Next, the strip is cut to form a lateral flap underlying each of the second plurality of loops. Finally, the flaps are folded, toward the prong-bearing side of the strip, so as to overlay the rest of the strip. This folding action captures the legs of one of the first plurality of loops and one of the second plurality between each folded flap and the strip, each of the second plurality of loops thereby being superimposed onto an associated one of the first plurality in an overlapping, interposed relationship. The result is a plurality of interconnected contact assemblies, each comprising an overlapped pair of loops forming a multi-wire contact, each contact being conductively connected to a prong at a right, or slightly obtuse, angle, the prong thereby forming a terminal pin.

The contact assemblies may either be left interconnected, or separated into individual contact assemblies, before being installed into a socket or like component, depending upon the particular application involved.

In the preferred embodiment of the invention, in which the loops are formed with radii near their closed ends, the radii form upraised "humps" which function as contact points. These "humps" also form an interlocking, box-like, spring contact configuration by restraining lateral movement of the overlapping loops. This effect is enhanced, in the preferred embodiment, when the closed end of one of the overlapped loops extends farther from the side of the strip than does the other loop. Thus, the result is a resilient, spring-like contact, of the multi-wire type, in which the overlapping loops, with their upwardly-radiused "humps", have a markedly reduced tendency toward splaying or tangling. In addition, with one loop extending farther outward than the other, the "humps" are staggered to present two pairs of staggered contact points, thereby enhancing the contact "footprint". Furthermore, by using closed loops for the wire elements, the total effective resistance of the lead/contact interface is somewhat lowered as compared to unlooped, straight wire elements.

In its other aspect, the present invention is the contact assembly produced by the above-described method. More particularly, the contact assembly so produced is characterized by a conductive pin having a shank portion and a tab portion disposed at an angle to the shank portion; and first and second elongate wire loops, each having a first end conductively connected to the tab portion, and a second, closed end extending away from the tab/shank juncture so as to be resiliently cantilevered, the first and second loops each having a pair of legs extending between the first and second loop ends, the loops being overlapped so that one leg of each loop is interposed between the legs of the other loop. When produced by the above-described method, the shank of the pin corresponds to one of the prongs extending from the conductive strip, while the tab portion of the pin corresponds to a segment of the strip from which the prong extends. In the preferred embodiment of the invention, the loops are configured with the staggered, upwardly-radiused "humps" in the legs, as described above, to provide the interlocking loop structure and two pairs of staggered contact points, with the resultant advantages, as previously summarized.

The present invention thus provides a contact assembly that has the advantages associated with a multi-wire contact, without the disadvantages of splayed or tangled wire elements. Furthermore, a contact assembly constructed in accordance with the present invention can be mass-produced economically, and lends itself readily to automated insertion into components, such as sockets. These and other advantages of the invention will be best appreciated from the detailed description which follows.

BRIEF DESCRIPTION OF THE DRAWINGS

The steps in the method of manufacturing a contact assembly in accordance with the present invention are illustrated in the drawings as follows:

FIG. 5 is a perspective view of a portion of the strip of FIG. 3 after the prongs have been bent to form what will be the shank portions of terminal pins;

FIG. 6 is a fragmentary perspective view showing a portion of the looped wire of FIG. 1 attached to a segment of the strip of FIG. 5;

FIG. 7 is a semi-schematic cross-sectional view showing the radii being formed in the wire loops;

FIG. 8 is a top plan view of the loop and strip assembly after the strip has been cut to form foldable flaps on one side thereof;

FIG. 9 is a top plan view, similar to FIG. 8, showing the flap after it has been folded; and FIG. 10 is a perspective view of a finished contact assembly.

DETAILED DESCRIPTION OF THE INVENTION

Figure 1:
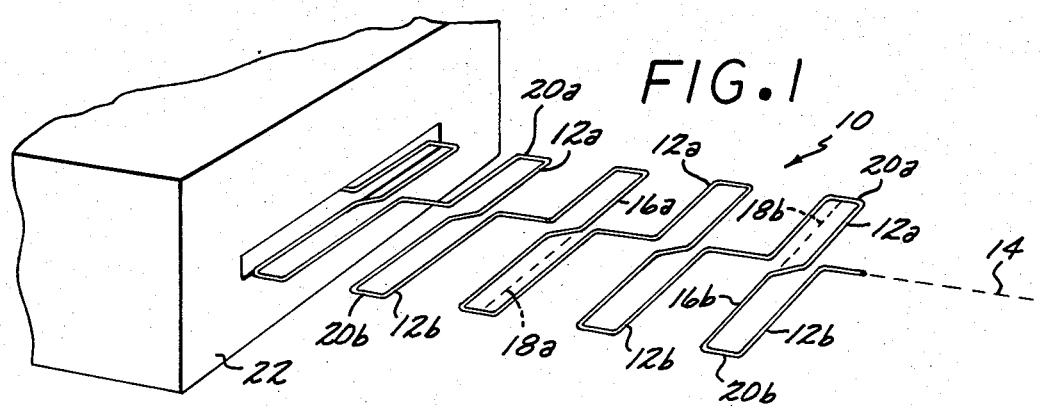
FIG. 1 is a semi-schematic perspective view showing the step of forming a length of wire into a continuous series of loops.

Referring first to FIG. 1, a length of conductive wire 10 is shown being formed into a continuous series of elongate, generally U-shaped loops 12*a* and 12*b*. The loops 12*a* constitute a first plurality of loops extending laterally from one side of a longitudinal axis 14, and the loops 12*b* constitute a second plurality of loops extending laterally from the opposite side of the axis 14. The loops 12*b* in the second plurality are axially offset or displaced from the loops 12*a* in the first plurality, so that each loop 12*a* in the first plurality has a leg 16*a* axially located along a line 18*a* extending between the legs 16*b* of a loop 12*b* in the second plurality, and each loop 12*b* in the second plurality has a leg 16*b* axially located along a line 18*b* extending between the legs 16*a* of a loop 12*a* in the first plurality. The loops 12*a* in the first plurality each terminate in a closed end 20*a*, while the loops 12*b* in the second plurality each have a closed end 20*b*.

The wire 10 may be of any suitable alloy of low electrical resistivity, and low susceptibility to corrosion and oxidation. In this regard, nickel-silver or Paliney wire are preferred, although other alloys may be suitable. The wire can be shaped into the loops 12*a* and 12*b* by a wire-shaping apparatus 22, of a type well-known in the art, such as a "four-slide" machine, for example.

Figure 2:
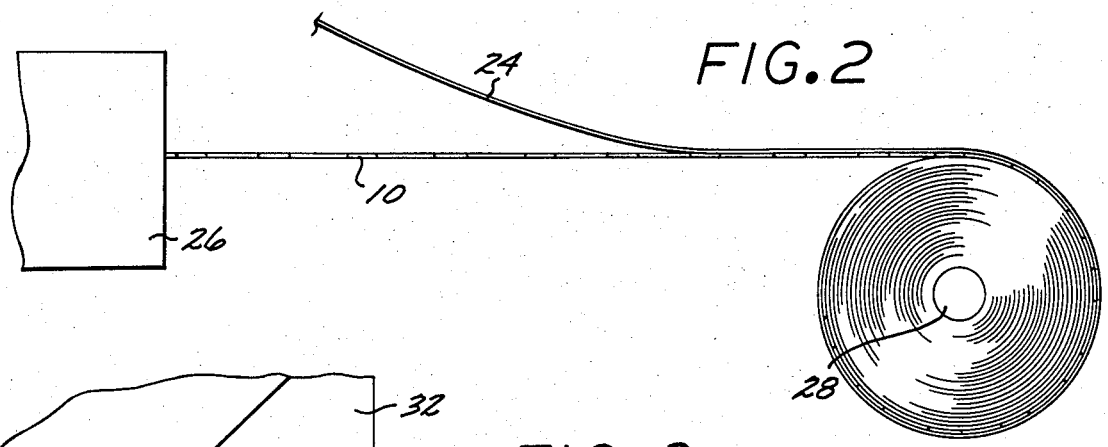
FIG. 2 is a semi-schematic elevational view showing the looped length of wire being coiled onto a reel of backing tape.

FIG. 2 shows a preferred way of storing the wire 10 after it has been formed into the loops 12*a* and 12*b*. The formed wire 10 is fed, from the forming apparatus 22 (FIG. 1) onto a backing tape 24, which is dispensed from a dispensing machine 26, and rolled onto a reel 28. The dispensing machine is advantageously of a type which applies an adhesive (not shown) to one side of the tape 24 so that the wire will adhere to it.

Figure 3:
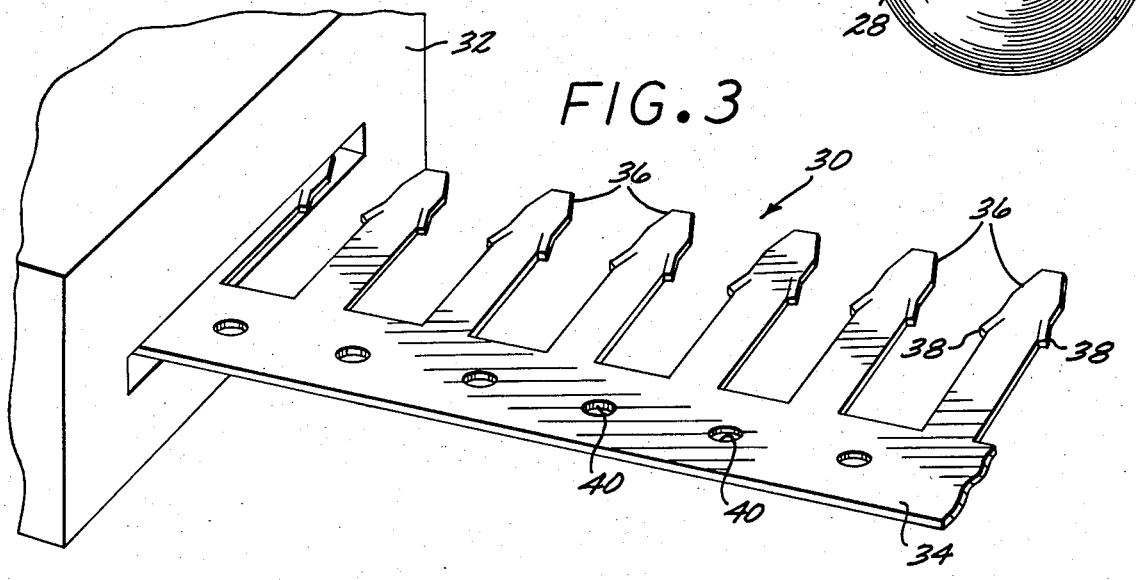
FIG. 3 is a perspective view of a conductive strip being formed with elongate prongs extending from one side thereof.

A strip 30 of conductive metal alloy is shown being formed in FIG. 3. The strip 30, preferably of beryllium-copper or similar alloy, may be stamped by a metal stamping apparatus 32, of a type well-known in the art. The stamping apparatus 32 employs a die (not shown) that stamps a flat ribbon of metal into the strip configuration shown in FIG. 3. Specifically, the strip 30, as formed by the apparatus 32, comprises a narrow band 34 having a series of evenly-spaced prongs 36 extending substantially horizontally from one side of the band. The prongs advantageously include barbs 38 on either side for engaging the plastic body of a component into which the prongs will be installed as terminal pins, as will be described below. The band 34 is preferably perforated with evenly spaced index holes 40 along its longitudinal axis. The index holes 40 may be engaged by a feed mechanism 42 (FIG. 4) for advancing the strip 30 through the manufacturing stations.

Figure 4:
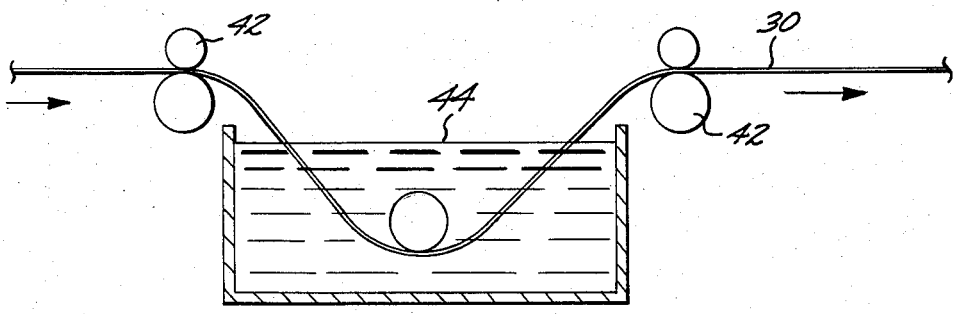
FIG. 4 is a semi-schematic view of the strip of FIG. 3 undergoing a metal-plating procedure.

The next station may, advantageously, be an electroplating bath 44, shown schematically in FIG. 4. In this station, the strip 30 is advanced by the feed mechanism 42 through the bath 44, where it is totally or selectively plated with a suitable conductive, solderable metal, such as gold or tin.

At the next manufacturing station, the prongs 36 are bent downwardly, as shown in FIG. 5, to form an angle with respect to the main part of the strip 30, i.e., the band 34. As best shown in FIG. 7, the prongs 36 are advantageously bent slightly more than 90 degrees from the horizontal, so that they form a slightly acute angle, designated by the letter "a" in FIG. 7, with the band 34. Preferably, the angle "a" is approximately 80 degrees, although the range of approximately 75 degrees to approximately 90 degrees may be suitable.

FIG. 6 illustrates the next step, that of attaching the looped wire 10 to the strip 30. It can be seen that the spacing between adjacent prongs 36 is nominally the same as the spacing between adjacent loops 12*a* in the first plurality of loops. Thus, when the looped wire 10 is attached to the strip 30, the loops 12*a* in the first plurality extend substantially horizontally into the spaces, previously occupied by the prongs 36 before the bending step shown in FIG. 5. The loops 12*b*, in the second plurality of loops, extend substantially horizontally outward from the opposite side of the strip. The attachment procedure may advantageously be performed by first removing the looped wire 10 from the backing tape 24 as the tape is unwound from the reel 28. Then, the looped wire 10 is soldered or welded to the strip 30 at the areas designated by the numeral 46, by conventional soldering or welding apparatus well-known in the art.

FIG. 7 illustrates the next work station in the sequence, wherein the loops 12*a* and 12*b* are inserted between the upper and lower jaws 48*a* and 48*b*, respectively, of a press. The jaws 48*a* and 48*b* have inner surfaces configured to form an upwardly convex radius or "hump" 50*a* in each leg 16*a* of each loop 12*a* in the first plurality, and a downwardly convex radius or "hump" 50*b* in each leg 16*b* of each loop 12*b* in the second plurality. The humps 50*a* and 50*b* are preferably formed near the closed ends 20*a* and 20*b*, respectively, of the loops 12*a* and 12*b*.

The next step in the manufacturing process is illustrated in FIG. 8. In this step, a flap 52 is formed in the area of the strip 30 underlying each of the loops 12*b* in the second plurality. Each of the flaps 52 is created by making lateral slots or cuts 54 and 56 into the band 34 on both sides of each loop 12*b*. Preferably, the cuts or slots 54 and 56 are configured to sever all connections between the loops 12*a* and 12*b* in the first and second pluralities. To this end, the cut or slot 54 terminates in an axial component 58 that isolates each loop 12*a* from its opposed loop 12*b*, while the cut or slot 56 on the opposite side of each loop 12*b* severs the connection between that loop 12*b* and the next loop 12*a* in axial sequence.

Next, each flap 52 is folded over the top of band 34, through approximately 180 degrees, toward the side of the strip bearing the prongs 36, as shown in FIG. 9. This folding action causes each loop 12*b* to be superimposed onto, and overlapped with, its opposed loop 12*a*, the legs 16*a* and 16*b* of each pair of overlapped loops 12*a* and 12*b* being captured between one of the flaps 52 and the underlying band 34. As a result of the folding, in each pair of overlapped loops 12*a* and 12*b*, one leg 16*a* of the loop 12*a* is interposed between the legs 16*b* of the loop 12*b*, while one leg 16*b* of the loop 12*b* is interposed between the legs 16*a* of the loop 12*a*. In the preferred embodiment, one of the loops in each overlapped pair, the loop 12*b*, for example, is made to extend farther from the edge of the strip 30 than the other loop. This can be accomplished, for example, by making the loops 12*b* in the second plurality longer than the loops 12*a* in the first plurality (or vice versa). Alternatively, the flaps 52 can be configured to be folded on either side of the longitudinal axis of the strip, so that they are hinged "off-center". In either case, the result of folding each of the flaps 52 is to form an interposed, overlapping pair of loops 12*a* and 12*b* with closed ends 20*a* and 20*b*, respectively, that are non-aligned both axially (in the direction of the longitudinal axis 14) and laterally (in the direction of the lateral lines 18*a* and 18*b*).

After the flap-folding step illustrated in FIG. 9, the finished contact assemblies each comprise a pair of interposed, overlapping wire loops 12*a* and 12*b* forming a multi-wire contact, and a prong 36 conductively connected to the contact by the band 34 and the flap 52 to form a terminal pin. As shown in FIG. 7, because the prongs 36 are preferably bent to form an angle "a" of slightly less than 90 degrees with respect to the strip 30, the prongs 36 thereby form an angle "b" of slightly greater than 90 degrees with respect to the contact formed by the loops 12*a* and 12*b*. The angle "b" may range in value (depending on the value of angle "a") from about 90 degrees to about 105 degrees, with the preferred value for angle "b" being approximately 100 degrees. Of course, if the angle "a" is approximately 90 degrees, angle "b" will also be approximately 90 degrees, the two angles being substantially supplemental.

A plurality of contact assemblies, each comprising a pair of interposed loops 12*a* and 12*b*, a prong 36, a segment of the band 34, and a flap 52, may be left interconnected by the band 34 for installation or insertion into a socket or other component by suitable automated equipment (not shown), such equipment not being a part of the present invention. Alternatively, the band 34 may be cut so as to separate the individual contact assemblies from each other, one such individual contact assembly being shown in FIG. 10.

The finished contact assembly, as shown in FIGS. 9 and 10, has a structure which provides several advantages. First, the prong 36 and the flap 52 are integral with one another and with the intervening segment of the band 34. The prong 36, the flap 52, and the intervening band segment 34 thus form a strong, integral terminal pin structure, wherein the prong 36 is the shank portion of the pin, the band segment 34 is the tab portion, and the flap 52 forms a retention element with the underlying tab portion, the inner ends of the loops 12*a* and 12*b* being captured therebetween.

Furthermore, the interposed, overlapping wire loops 12*a* and 12*b*, as a result of their being so captured at their inner ends, have free ends that are resiliently cantilevered, thereby giving them a resilient spring action that enhances their ability to maintain a positive, low-resistance electrical connection with the lead of an electrical component (not shown), with which the contact may be engaged. Further enhancing the quality of the electrical connection, in the preferred embodiment of the invention, is the axial and lateral non-alignment of the loops 12*a* and 12*b*, the closed end of one loop thereby extending farther outward from the juncture between shank and tab portions of the terminal pin (the prong 36 and the band segment 34, respectively) than does the closed end of the other loop. This construction causes the convex radii or humps 50*a* and 50*b* in the loop legs to be staggered, whereby the humps 50*a* alternate with the humps 50*b*, one pair of humps extending out farther from the shank portion/tab portion juncture than does the other pair. Thus, the two pairs of humps 50*a* and 50*b* form four discrete contact points for electrical contact with a co-engaged lead. In addition, the staggered humps 50*a* and 50*b* help restrain any movement of the loops 12*a* and 12*b* relative to one another, thereby enhancing the structural integrity of the contact. This motion-limiting action of the humps 50*a* and 50*b*, coupled with the use of closed-end wire loops, substantially eliminates splaying of the wire contact elements when engaged with the lead of an electronic component. The ability of the multi-wire contact formed by the loops 12*a* and 12*b* to resist acquiring a set is not, in any way, diminished by this structure.

Still another advantage results from the use of looped wire elements: As compared to the separate, unlooped, straight wire elements of prior art multi-wire contacts, the looped elements of the present invention are believed to provide a somewhat lower effective resistance at the contact/lead interface.

Thus, the present invention provides a contact assembly that offers all of the advantages traditionally associated with multi-wire contacts, but without the disadvantages, namely, the splaying or tangling of the wire components. The method of manufacturing these contact assemblies lends itself to economical and efficient mass production, thereby providing the contact assemblies at relatively low cost.

While a preferred embodiment has been described above, various modifications will suggest themselves to those skilled in the pertinent arts. For example, the number of wire loops forming each contact may be increased to three or more, and the specific configuration of the loops may be altered. In some applications, it may be advantageous to omit the humps 50*a* and 50*b*, or to change their location or configuration. Furthermore, the flaps 52 may be formed in a variety of ways, or, possibly, substantially eliminated. These and other modifications should be considered within the spirit and scope of the invention, as defined in the claims which follow.

What is claimed is:

1. A method for manufacturing a contact assembly for an electronic component, comprising the steps of:

(1) providing a length of conductive wire formed into a continuous series of elongate loops each having a pair of legs joined at a closed end, said series or loops comprising first and second pluralities of loops extending laterally in opposite directions from a longitudinal axis, said second plurality being axially displaced from said first plurality such that each loop in said second plurality has a leg located axially between the legs of a loop in said first plurality, and each loop in said first plurality has a leg located axially between the legs of a loop in said second plurality;

(2) providing a strip of conductive metal having a plurality or spaced-apart prongs extending from one side thereof, the spacing between adjacent ones of said prongs being nominally equal to the spacing between adjacent loops in said first plurality of loops;

(3) bending said prongs to form an angle of slightly less than, or approximately equal to, 90 degrees with said strip;

(4) attaching said length of wire to said strip so that each of said first plurality of loops extends substantially horizontally from said strip substantially into the space previously occupied by one of said prongs prior to said bending step, each of said second plurality of loops thereby extending substantially horizontally outward from the side of said strip opposite said first plurality of loops;

(5) forming an upwardly convex radius in the legs of each of said first plurality of loops near the closed end thereof, and a downwardly convex radius in the legs of each of said second plurality of loops near the closed end thereof;

(6) cutting said strip to form a lateral flap underlying each of said second plurality of loops; and (7) folding each of said flaps approximately 180 degrees toward the side of said strip bearing said prongs, so that each of said second plurality of loops is superimposed onto one of said first plurality of loops, with one leg of each of said second plurality of loops interposed between the legs of one of said first plurality of loops, and one leg of each of said first plurality of loops interposed between the legs of one of said second plurality of loops, thereby forming a plurality of interconnected contact assemblies, each comprising a pair of interposed wire loops forming a multi-wire contact, and a prong conductively connected to said contact at an angle of approximately equal to, or slightly greater than, 90 degrees to form a terminal pin.

2. The method of claim 1, further comprising the step of:

separating said interconnected contact assemblies from each other.

3. The method of claim 1, wherein said strip is a copper alloy plated with a metal selected from the group consisting of gold and tin.

4. The method of claim 1, wherein said bending step comprises the step of bending each of said prongs to form an angle of between approximately 75 degrees and approximately 90 degrees with said strip.

5. The method of claim 4, wherein, as a result of said folding step, each of said terminal pins forms an angle of between approximately 90 degrees and approximately 105 degrees with its associated contact.

6. The method of claim 1, wherein said length of wire formed into said continuous series of loops is provided on a backing tape, and said attaching step comprises the step of separating said length of wire from said backing tape.

7. The method of claim 1, wherein, as a result of said folding step, the closed ends of each pair of interposed loops are non-aligned, both axially and laterally, so that, for each contact so formed, the convex radii near the closed end of each interposed loop form two pairs of staggered convex contact points.

8. The method of claim 1, wherein said cutting step comprises the step of cutting a slot laterally into said strip on either side of each of said second plurality of loops.

9. A method for manufacturing a contact assembly for an electronic component, comprising the steps of:

(1) forming a length of conductive wire into a continuous series of elongate loops each having a pair of legs joined at a closed end, said series of loops comprising first and second pluralities of loops extending laterally in opposite directions from a longitudinal axis, said second plurality being axially displaced from said first plurality such that each loop in said second plurality has a leg located axially along a lateral line extending between the legs of a loop in said first plurality, and each loop in said first plurality has a leg located axially along a lateral line extending between the legs of a loop in said second plurality;

(2) forming a strip of conductive metal having a plurality of spaced-apart prongs extending from one side thereof, the spacing between adjacent ones of said prongs being nominally equal to the spacing between adjacent loops in said first plurality;

(3) bending said prongs through an angle in the range of about 90 degrees to about 105 degrees to form a right or slightly acute angle with said strip;

(4) attaching said length of wire to said strip so that each of said first plurality of loops extends substantially horizontally from said strip substantially into the space previously occupied by one of said prongs prior to said bending step, and each of said second plurality of loops extends substantially horizontally outward from the opposite side of said strip;

(5) cutting said strip to form a lateral flap underlying each of said second plurality of loops; and (6) folding each of said flaps toward the side of said strip bearing said prongs so that the legs of one of said first plurality of loops and the legs of an associated one of said second plurality of loops are captured between each of said tabs and said strip, each of said second plurality of loops being thereby superimposed onto the associated one of said first plurality of loops in overlapping relationship therewith to form a plurality of interconnected contact assemblies, each comprising an overlapped pair of loops forming a multi-wire contact, and a prong conductively connected to said contact at an angle in the range of about 90 degrees to about 105 degrees to form a terminal pin.

10. The method of claim 9, further comprising the step of forming a radius in the legs of each of said loops near the closed end thereof, so that the radii in the legs of each overlapping pair of loops from two pairs of upraised contact points.

11. The method of claim 10, wherein said step of forming said radii is performed after said attaching step, and comprises the steps of:

(1) forming an upwardly convex radius in the legs of each of said first plurality of loops near the closed end thereof; and (2) forming a downwardly convex radius in the legs of each of said second plurality of loops near the closed end thereof.

12. The method of claim 9, further comprising the step of separating said interconnected contact assemblies from each other.

13. The method of claim 9, wherein, as a result of said folding step, said overlapped pair of loops are laterally non-aligned, so that one of said pair of loops extends laterally from said strip farther than does the other one of said pair.

14. The method of claim 9, wherein said attaching step is performed by welding.

15. The method of claim 9, wherein said attaching step is performed by soldering.

16. The method of claim 9, wherein said cutting step comprises the step of cutting a slot laterally into said strip on either side of each of said second plurality of loops.

* * * * *